United States Patent [19]

Fields

[11] 4,098,418

[45] Jul. 4, 1978

[54] SAFETY CLOSURE

[76] Inventor: Mack Robert Fields, 1624-2 Lake Dr., Clearwater, Fla. 33516

[21] Appl. No.: 840,547

[22] Filed: Oct. 11, 1977

[51] Int. Cl.[2] ..... B65D 55/16

[52] U.S. Cl. ..... 215/206; 215/211; 215/213; 220/281

[58] Field of Search ..... 215/206, 211, 213, 301; 220/281

[56] References Cited

U.S. PATENT DOCUMENTS

| | | | |
|---|---|---|---|
| 3,759,411 | 9/1973 | Horvath | 215/206 X |
| 3,860,133 | 1/1975 | Boxer et al. | 215/206 |
| 3,980,194 | 9/1976 | Costa | 215/206 X |

*Primary Examiner*—George T. Hall

*Attorney, Agent, or Firm*—Wegner, Stellman, McCord, Wiles & Wood

[57] ABSTRACT

A safety closure is provided for a container which container has a continuous upwardly extending neck and a continuous radially outwardly extending flange spaced from the outer edge of said neck. The closure is provided with a portion for seating against the inside of the neck and has a flared skirt which terminates either within or substantially even with the outer edge of the flange. The skirt is made of a pliable material and is reinforced against the neck of the container except for two closely spaced segments of the skirt. The spacing between the segments is supported against the neck of the container so that depressing the two segments will bulge the skirt between the segments outward beyond the confines of the flange whereby upward pressure below the bulged portion will strip the closure from the container.

18 Claims, 17 Drawing Figures

FIG. 1
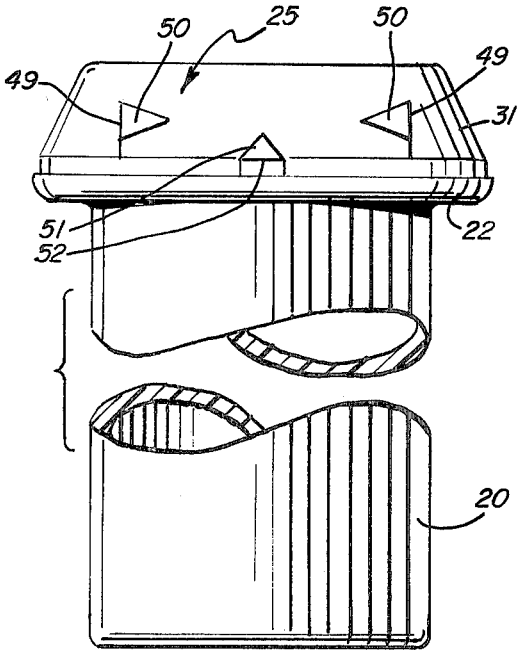
FIG. 2
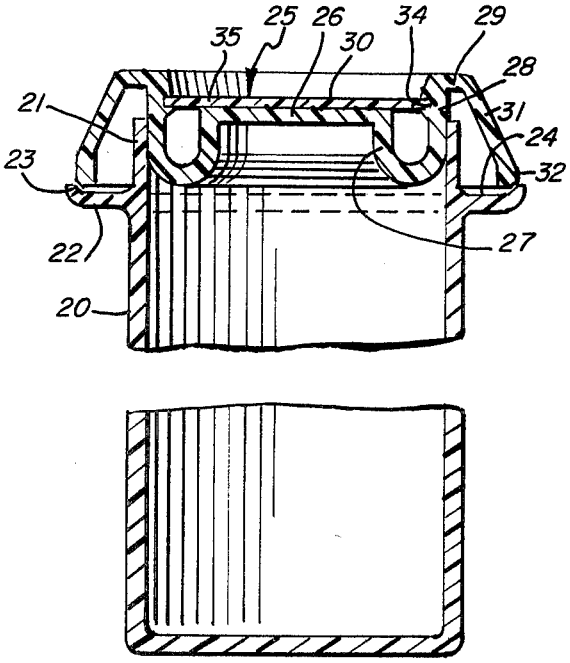
FIG. 3
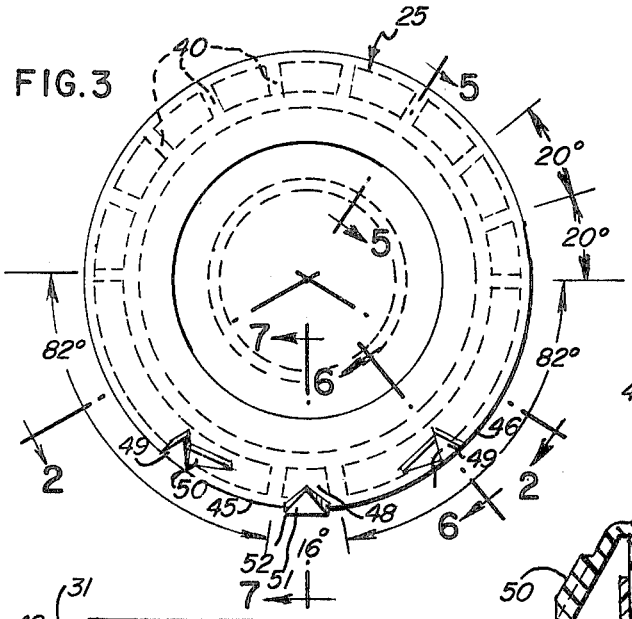
FIG. 4
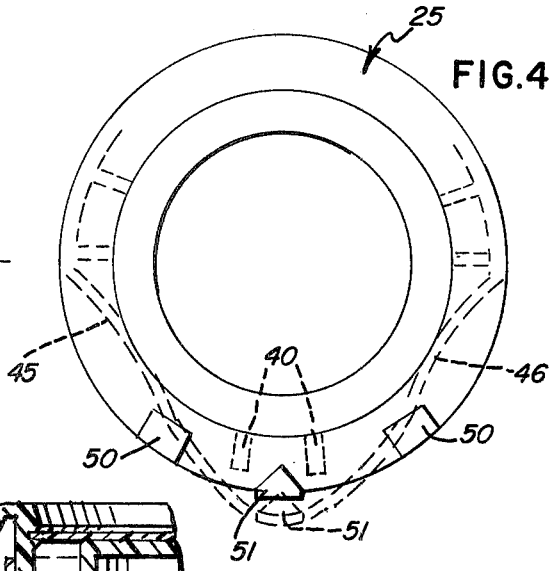
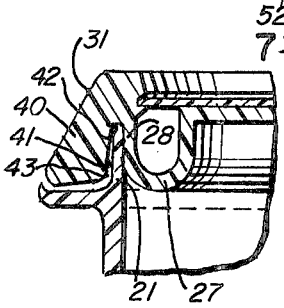
FIG. 5
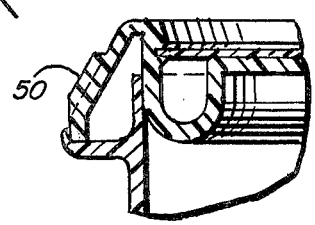
FIG. 6
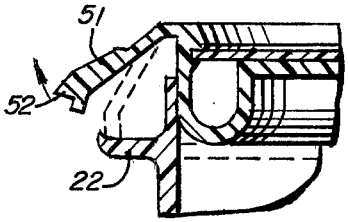
FIG. 8
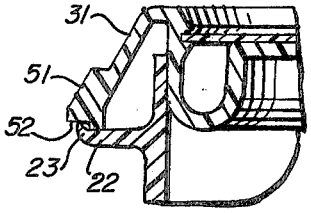
FIG. 7

FIG. 10
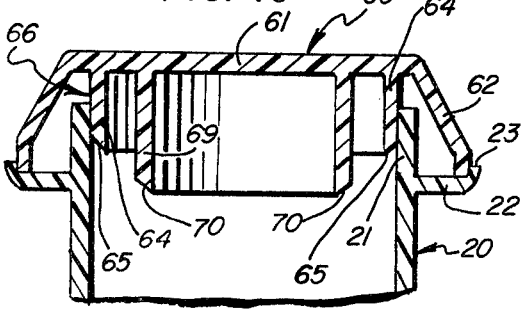
FIG. 9
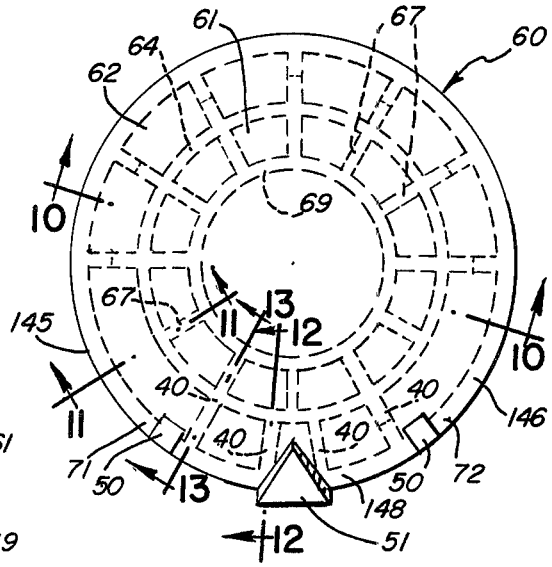
FIG. 11
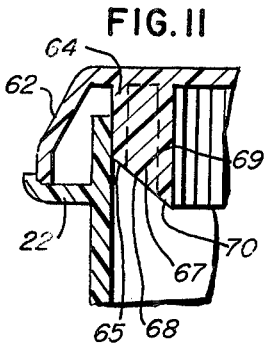
FIG. 12
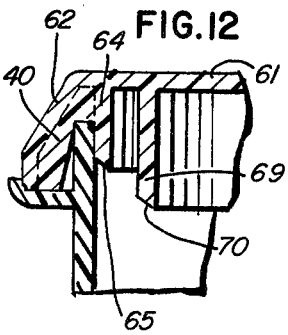
FIG. 14
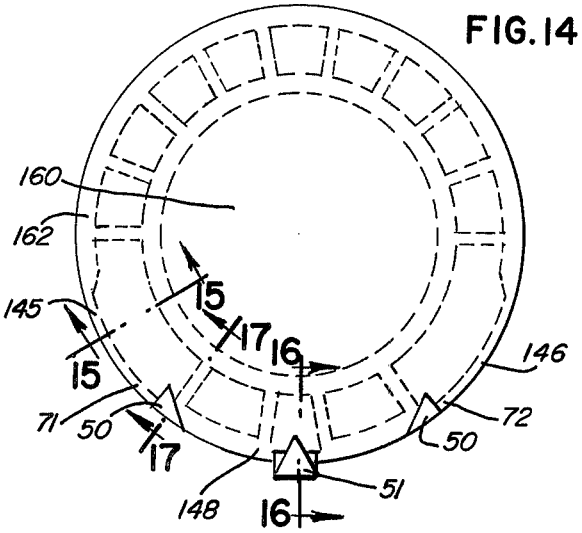
FIG. 13
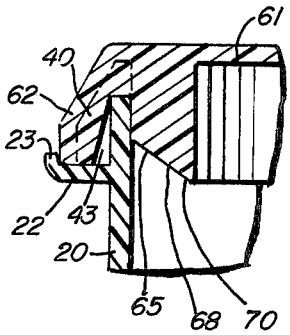
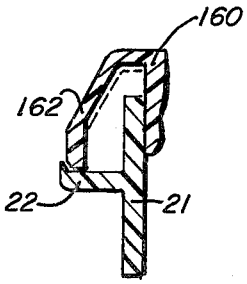
FIG. 15
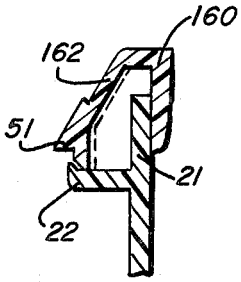
FIG. 16
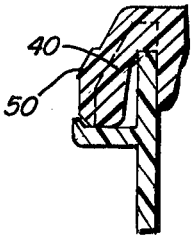
FIG. 17

SAFETY CLOSURE

BACKGROUND OF THE INVENTION

1. Field of the Invention

This invention relates to closures and, more particularly, to safety closures which cannot be readily removed by a child.

2. Description of the Prior Art

Government regulations were passed several years ago that made it obligatory for parties dispensing potentially dangerous goods to the public to provide safety closures on the containers containing the goods. In the area of medicines, such as pills and liquid medications, it has been necessary to provide closures which are intended to prevent children from gaining access to the medicines. In the process of making the closures child proof, the closures have been made very difficult, if not impossible, for adults needing the medication, but suffering from arthritis or other enfeebling illnesses, from gaining access to the medication.

Some existing safety closures require the user to take the container into a lighted area so that the marks on the container can be visually lined up to make it possible to open the container.

Other closures require that the cap be rotated relative to the container until certain elements line up whereupon a manipulation of the cap will remove it from the container. Those prior containers that are intended for storing a moisture absorbing medication cannot use the rotating cap concept since it did not provide a moisture seal between the cap and the container.

Still other closures require that the container be distorted inward at a certain weakened location so as to unsecure the closure from the container. These last-named closures cannot be used when the container is full since the collapsing container would crush the contents.

SUMMARY OF THE INVENTION

The present invention overcomes the problems of the prior art devices and provides a safety closure which seals the contents of the container from moisture so as to conform with federal law requiring child-proof containers to be tightly closed. The closure does not have to be turned relative to the container to align cooperating interfitting parts to permit removal of the closure from the container. And the closure does not have to be taken into an illuminated area so as to visually align appropriate parts so as to be removable from the container.

The present invention is used with a container having a continuous radial flange spaced from a continuous axial end of a neck of the container. The closure has a seal engaging with the inside of the neck to seal the contents from moisture and has a skirt flared outwardly to a location with the outer surface substantially aligned with the outer edge of the annular flange so that it is not possible to gain a purchase on the skirt to remove it from the container. Most of the skirt is radially supported against the neck of the container with the skirt having a pair of unsupported segments which have adjacent ends spaced apart a short distance. The portion of the skirt between said segments is supported against the neck of the container. Raised feeler indicators are formed on the surface of the unsupported segments of the skirt so that even a blind person can be trained to locate the indicators and depress them and the underlying skirt whereupon the short supported portion between the segments will bulge radially outward beyond the edge of the flange whereupon a finger of the user can get a purchase below the bulged portion and lift the closure to strip it from the container.

In a modified form of invention, the unsupported segments are reduced in circumferential length and are weakened. The shorter segment reduces the likelihood that a child will accidentally deflect the unsupported segments and the weakened segment will facilitate actuation of the closure by an adult.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 1 is an elevational view of a container having a closure embodying my invention;

FIG. 2 is a cross-sectional view taken along the line 2—2 of FIG. 3;

FIG. 3 is a top plan view of the closure of FIG. 1;

FIG. 4 is a view similar to FIG. 3 only with unsupported segments of the closure deflected;

FIG. 5 is a cross-sectional view taken along the line 5—5 of FIG. 3;

FIG. 6 is a cross-sectional view taken along the line 6—6 of FIG. 3;

FIG. 7 is a cross-sectional view taken along the line 7—7 of FIG. 3;

FIG. 8 is a view similar to FIG. 7 only with the portion of the skirt bulged outward ready to be used to peel the closure from the container;

FIG. 9 is a top plan view of a modified form of closure;

FIG. 10 is a cross-sectional view taken along the line 10—10 of FIG. 9;

FIG. 11 is a cross-sectional view taken along the line 11—11 of FIG. 9;

FIG. 12 is a cross-sectional view taken along the line 12—12 of FIG. 9;

FIG. 13 is a cross-sectional view taken along the line 13—13 of FIG. 9;

FIG. 14 is a top plan view of another modified form of closure;

FIG. 15 is a cross-sectional view taken along the line 15—15 of FIG. 14;

FIG. 16 is a cross-sectional view taken along the line 16—16 of FIG. 14; and FIG. 17 is a cross-sectional view taken along the line 17—17 of FIG. 14.

DESCRIPTION OF THE PREFERRED EMBODIMENT

Referring to one preferred form of the invention shown in FIGS. 1 through 8, a rigid container 20 is provided with an axially extending, open-ended neck 21 and a radially outwardly extending flange 22 spaced from the end of said neck. The flange 22 has a peripheral lip 23 formed around the outer edge of the flange and extends laterally upwardly from the upper surface 24 of said flange. A closure or cap 25 is provided for closing the opened neck 21 of the container 20 and for preventing the ingress of moisture into the container when the closure is in place.

The closure or cap 25 is formed of a pliable material and has a recessed body portion 26 which has a dependent seal ring 27 formed around the peripheral portion of said body. A typical material for the closure or cap, that has been found to operate successfully, is an EVA compound, such as a low to medium density polyethelene. The seal ring 27 is shown comprised of an annular hollow donut-shaped channel with an outer wall 28 of the ring extending axially upward and terminating in a radial ridge or shoulder 29 which is spaced above the plane of the body 26 so that the body 26 can be said to have a recessed top 30. An outwardly flared dependent skirt 31 is formed integrally with the outer edge of the shoulder 29 and terminates in a short vertical section 32 which has an edge, as shown in FIG. 2, spaced slightly above the upper surface 24 of the flange 22 with the outer edge being protected by the peripheral lip 23 of the flange. The recommended included angle that the skirt 31 makes with the vertical is 30° which is sufficient to prevent a child from getting a grip on the cap sufficient to break the seal between the ring 27 and the inside of the neck of the container. As shown, the outer wall 28 of the seal ring 27 has a continuous undercut groove 34 therearound in which groove 34 is seated the edge of a circular disc 35 which may be of stiff paperboard, or the like, and may be used to contain instructions, advertising, or the like.

As shown in FIGS. 3, 5, 6 and 7, the cap or closure 25 has a plurality of spaced apart radial ribs 40 extending, in part, between the skirt 31 and the outer wall 28 to provide support for the skirt therebetween. The radial ribs 40 have, in a depending portion of the skirt 31, a tapered wall 41 which terminates in an axially facing bottom 42, which tapered wall 41, bottom 42 and the outer surface of the wall 28 of the seal ring 27 forms a cylindrical recess 43 which is adapted to receive the axial end portion of the neck 21. The ribs 40, in the vicinity of the cylindrical recess 43, are adapted to be pushed against the neck 21 of the container 20 to support the skirt 31 and thereby maintain the lower edge of the skirt 31 within the confines of the peripheral lip 23 of the flange 22. As illustrated, there are ten spaced apart radial ribs 40 which, as shown, supports about one-half of the skirt 31 with respect to the neck 21 of the container.

There are two unsupported, non-rib reinforced segments 45, 46 of the skirt 31. One end of each segment 45, 46 is spaced apart from each other by a short portion 48 of rib reinforced skirt 31. That is, the end portions of the segments 45, 46 adjacent each other have a pair of spaced apart radial ribs 40, which ribs support the short portion 48 between said adjacent end portions of the unsupported segments 45, 46. The ribs 40 between the adjacent ends of the segments 45, 46 are identical in construction to the ribs 40 previously described and have a cylindrical recess 43 formed therein so that the rib 40 is supported against the outer surface of the neck 21 of the container. For illustration purposes and as shown in the drawings, the segments 45 and 46 are each approximately 82° in length with the short portion 48 between the adjacent ends of the segments 45, 46 being approximately 16° in length.

Positioned at points slightly offcenter on the outer surface of the skirt 31 of the segments 45, 46, is a pair of feeler lugs 50, which feeler lugs 50 are arrow shaped with the points of the arrows pointing toward each other and toward the supported short portion 48 of the skirt. This will leave the wide raised back portion 49 of the arrows spaced outwardly from each other with said raised portions 49 extending radially outward farther than the points of the arrows. A lifting lug 51 is formed on the skirt 31 at a location centered with respect to the supported short portion 48 of the skirt. The lug 51 points axially upward with respect to the closure 25 and has the broad back part 52 of the lug projecting radially outward from the skirt 31 and, as shown in FIG. 7, may have a small overlap with respect to the peripheral lip 23 of the flange 22. The amount of overlap of the lifting lug 51 is so small that it is not possible to get a purchase below the lug 51 to force the closure 25 from the container.

In assembling the cap or closure 25 on the container 20, the sloping edges 41 of the ribs 40 and the shaped surfaces of the wall 28 of the seal ring 27 act as a guide for guiding the sealing portion of the closure into the neck 21 of the container 20 wherein the seal ring 27 yields into compressive engagement with the inner surface of the neck 21 to a point where the bottom 42 of the cylindrical recess 43, formed in the closure, engages with the end face of the neck 21 which will position the outer edge of the skirt 31 in a protected position with respect to the peripheral lip 23 of the flange 22. In this position, it is not possible for a user to remove the cap by attempting to push the cap upward, since there is no purchase surface below the outer edge of the skirt 31 of the closure. Even where the lifting lug 51 projects slightly beyond the lip 23 of the flange 22, it is not possible to produce enough axial force to separate the closure from the container. The slope of the skirt 31 is likewise such that it is not possible to get a grip thereon sufficient to lift the closure from the container. For example, the slope of the skirt 31 can form an angle of around 30° to the axis of the container, which angle is sufficient to prevent anyone getting a grip on the closure.

To remove the closure 25 from the container 20, the user feels the surface of the skirt 31 until a thumb and one finger engage the respective feeler lugs 50 on the skirt 31. Radial inward pressure on the feeler lugs 50 and pressure on the lugs 50 toward each other will collapse the unsupported segments 45, 46 of the skirt 31 into the dashed line position shown in FIG. 4. The short supported portion 48 of the skirt 31 between the segments 45 and 46 will bulge outwardly with respect to the neck 21 of the container 20 so that the edge of the skirt 31 with the lug 51 will bulge outwardly beyond the edge of the flange 22 whereupon a finger placed below the bulged out portion 48 will permit the closure 25 to be peeled upwardly and away from the neck 21 of the container. Once the user becomes familiar with the operation of the closure, he will be able to use a thumb and a middle finger on the two spaced apart feeler lugs 50 on the unsupported segments 45 and 46 with the opposite wall of the container and closure bearing against the palm of the hand. Pressure on the spaced apart feeler lugs 50 will deflect the unsupported segments 45, 46 inwardly and will bulge the portion 48 between the segments 45 and 46 outwardly so that the index finger can be positioned below the lifting lug 51 on the skirt 31 whereupon upward pressure by the index finger will peel the closure 25 from the container.

Referring to FIGS. 9 through 13, a modified form of sealing arrangement is provided. That is, a closure or cap 60 has a planar body portion 61 with a downwardly depending angled or flared skirt portion 62 depending from the outer peripheral edge thereof. The container 20, as previously described, has the neck portion 21 with the flange 22 and lip 23 formed thereon such that the bottom edge of the skirt 62 is aligned with and within the confines of the lip 23 of the flange 22 in the same manner as previously described.

Downwardly depending from the inner surface of the body 61 is a cylindrical sleeve 64 which has a sloping end wall 65 axially extending therefrom. The end wall 65 diverges toward a point which is the apex of a cone of which cone end wall 65 is a segment thereof. The sloping end wall 65 serves as a guide for guiding the cylindrical sleeve 64 into the neck 21 of the container 20. The cylindrical sleeve 64 acts as a sealing ring 66 with additional backing on the ring for sealing purposes being provided by a plurality of equally spaced apart ribs 67 molded integrally therewith around the inner surface of the cylindrical sleeve 64. The ribs 67 have tapered end walls 68, which end walls 68 align with the end walls 65 on the cylindrical sleeve 64 and act as guide extensions for guiding the sealing ring 66 into the neck 21 of the container 20. FIG. 10 shows the cylindrical sleeve 64 at a non-reinforced location where FIG. 11 shows the cylindrical sleeve 64 with a reinforcing rib 67 integrally formed therewith. A concentric, but smaller diameter, sleeve 69 is formed integrally with the body portion 61 and projects downwardly from said portion 61 a distance greater than the length of the sleeve 64. The sleeve 69 is integrally connected with the inner extremes of each reinforcing rib 67 and has a tapered end wall 70, which end wall 70 aligns with the tapered end walls 68 on the ribs 67 and the tapered end wall 65 on the sleeve 64. The plurality of ribs 67, as shown in FIG. 9, and the sleeve 69, as shown in FIGS. 10–12, forms a backing arrangement for sleeve 64 so as to prevent the sleeve 64 from collapsing. The sleeve 64, being reinforced, presses against the neck 21 to better seal the closure against the ingress of moisture into the container 20. The tapered end walls 65, 68 and 70 act as guides for guiding the closure into the neck of the container. The openings between the ribs 67 and the sleeves 64 and 69 are too small to trap and hold a pill.

Radial reinforcing ribs 40 are formed on the inner surface of the skirt 62 in the same manner as discussed with respect to the form of invention shown in FIGS. 1 through 8. There are two unsupported, non-rib reinforced segments 145, 146 of the skirt 62. One end of each segment 145, 146 is spaced apart from each other by a portion 148 of rib reinforced skirt 62. That is, the end portions 71, 72 of the segments 145, 146, respectively, adjacent each other have four spaced apart radial ribs 40, which ribs support the portion 148 between said adjacent end portions 71, 72 of the unsupported segments 145, 146. The ribs 40 between the adjacent ends of the segments 145, 146 are identical in construction to the ribs 40 previously described and have a cylindrical recess 43 formed therein so that the rib 40 is supported against the outer surface of the neck 21 of the container. For illustration purposes and as shown in the drawings, the segments 145 and 146 are each approximately 55° in length with the portion 148 between the adjacent ends 71, 72 of the segments 145, 146 being approximately 70° in length.

Positioned at points in the end portions 71, 72 of the segments 145, 146 in the outer surface of the skirt 62 is a pair of feeler lugs 150, which feeler lugs 150 are arrow shaped with the points of the arrows pointing toward each other and toward the supported portion 148 of the skirt. This will leave the wide raised back portion 149 of the arrows spaced outwardly from each other with said raised portions 149 extending radially outward farther than the points of the arrows. The arrows are located in close proximity to, but in the unsupported side of, the ribs 40 located adjacent the ends 70, 71 of the unsupported segments 145, 146. A lifting lug 51, identical to the lifting lug described with respect to FIGS. 1 through 8, is provided on skirt 62 centered with respect to the supported portion 148 of the skirt. The closure of FIGS. 9 through 13 functions in the same manner as heretofore described. The principal modification contemplated by FIGS. 9 through 13 is to provide an alternate form of seal for the closure, which seal can be molded integrally with the body of the closure to simplify manufacturing of the closure while still providing adequate sealing characteristics or capabilities for the closure. In addition, the additional rib 40 between the skirt 62 and the sleeve 64 does not affect the depressing of the unsupported portions 145, 146 nor does it affect the bulging of the portion 148 outward beyond the edge of the flange 22 so that the closure can be stripped from the container. What the additional ribs 40 do accomplish is a more child-proof closure structure. That is, a child trying to grip the closure will have less space where he might accidentally depress the unsupported portion of the skirt, but even an accidental depressing of one or both of the unsupported segments 145, 146 will not remove the closure, since the additional manipulation of pealing the closure from the container is necessary.

Referring to the modification shown in FIGS. 14 through 17, a closure 160, quite similar to FIGS. 9 through 13, is shown. The form of seal on the inside of the closure could be the type shown in FIGS. 1 through 8 or the type shown in FIGS. 9 through 13 and a description of neither will be repeated at this time. The closure 160 has the additional pair of ribs 40 close to the end portions 71, 72 of the unsupported segments 145, 146 as described with respect to FIGS. 9 through 13. In addition, the thickness of the skirt 162 has been reduced on the inside of the skirt in the unsupported segments 145, 146 and beneath the lifting lug 51. The reduced thickness of the unsupported portion 145, 146 facilitates collapsing or distorting the unsupported portions 145, 146 inward and bulging the portion 148 outward beneath the lift lug 51. This can be of significance for use with people with limited strength in their fingers, due to illness, but who have the mental capability of manipulating the closure.

From the above, it is clear that I have provided an improved closure for a container, which closure can effect a moisture tight seal with the container, and which container has feeler lugs, which can be found by a user even in the dark, and upon depressing the feeler lugs a portion of the closure is projected beyond the flange of the container an amount sufficient to permit purchase thereunder to strip the closure from the container. The pliable material from which the closure is molded affords a positive moisture seal with the container and permits the unsupported segments to distort inward which forces the intermediate supported portion outward to provide a purchase for removing the closure. The angle of the skirt will not permit a grip sufficient to lift the closure except in the manner prescribed.

I claim:

1. A closure device for selectively opening and closing a container, said device comprising in combination, a body portion having a circular seal depending therefrom, a skirt flared outwardly and depending downwardly from said body portion, means for supporting a relatively long portion of said skirt relative to said seal, two segments of said skirt being unsupported by said supporting means, a shorter portion of said skirt separating adjacent ends of said segments, and means for supporting said shorter portion of skirt relative to said seal, whereby pressure on said two segments distorts said portion of skirt outward.

2. A closure device as claimed in claim 1 wherein said means for supporting said skirt are radial ribs which are spaced apart approximately 20°.

3. A closure device as claimed in claim 1 wherein each said unsupported segment is from 50° to 85° in length.

4. A closure device as claimed in claim 1 wherein said shorter portion of skirt between the unsupported segments is from 10° to 80° in length.

5. In a closure for a container having a neck and a flange extending radially outward from said neck, said closure having a body portion with a seal depending therefrom, a downwardly depending and flared skirt carried by said body portion and encircling said seal, means for supporting at least half of said skirt relative to said seal, two segments of said skirt being unsupported relative to said seal, a second supported portion of said skirt extending between adjacent ends of said unsupported segments of said skirt whereby said closure seated on said container with said skirt aligned with said flange can be removed by depressing said unsupported segments and strip said closure from said container.

6. In a closure as claimed in claim 5 wherein said means for supporting said skirt comprises a plurality of spaced apart ribs carried by the inner surface of said skirt.

7. In a closure as claimed in claim 5 wherein feeler means are positioned on said unsupported segments so as to indicate where pressure should be applied for removing the closure from the container.

8. In a closure as claimed in claim 5 wherein depressing said unsupported segments will distort said second supported portion of the skirt outward beyond the flange whereupon axial pressure on said distorted portion will strip the closure from the container.

9. In a closure as claimed in claim 5 wherein said unsupported segments of the skirt are radially thinner than the remaining segments of the skirt so as to provide less resistance to being depressed.

10. A closure device for selectively opening and closing a container having a neck portion and a flange portion, said device comprising, in combination, a body portion having a circular seal depending therefrom, a skirt carried by said body portion and flared downwardly to present a continuous lower edge, said lower edge aligning with and being within the confines of the outer edge of said flange, a plurality of spaced apart radial ribs extending from said skirt toward said seal, a continuous recess formed between part of each rib and said seal to permit the neck on the container to seat therein, two segments of said skirt being unsupported by ribs with adjacent ends of said segments being spaced from each other by a short portion of said skirt, ribs extending from said short portion of skirt toward said seal for providing support for said short portion of skirt, feeler means on each unsupported segment of said flange whereby pressure on said feeler means collapses said unsupported segments and distorts said short portion of skirt outward beyond the outer edge of said flange on said container whereby upward pressure on said short portion will strip the device from said container.

11. A closure device as claimed in claim 10 wherein said seal is a ring-shaped member sealingly engaging the inner surface of said container neck to effect a seal therewith.

12. A closure device as claimed in claim 10 wherein said seal is a cylindrical sleeve having a tapered lower edge for guiding said seal into the neck of the container and reinforcing means on said sleeve for resisting collapsing of said sleeve under pressure.

13. A closure device for selectively opening and closing a container having a neck and a radial flange, said device comprising a body portion having a seal depending therefrom, a shoulder extending radially outward from an upper edge of said seal, a skirt flared downwardly and outwardly from said shoulder to present a continuous lower edge which is positioned inward from the outer edge of said flange, a plurality of spaced apart ribs extending inwardly from a major portion of said skirt to support said skirt relative to said seal, two segments of said skirt being unsupported by said ribs with adjacent ends of said segments being spaced from each other by a short portion of said skirt, ribs extending from said short portion of skirt toward said seal for providing support for said short portion of skirt, feeler means carried by each unsupported segment, each feeler means being located offcenter toward said short portion of skirt whereby pressure on said feeler means collapses said unsupported segments and distorts said short portion of skirt outward beyond said edge of said flange on said container whereby axial pressure on said distorted short portion of skirt will strip the device from said container.

14. A closure device as claimed in claim 13 wherein said ribs are spaced apart 20°.

15. A closure device as claimed in claim 13 wherein each said unsupported segment is 82° in length.

16. A closure device as claimed in claim 13 wherein said short portion of skirt is 16° in length.

17. A closure device as claimed in claim 13 wherein a lug is formed on said short portion of skirt which lug projects substantially even with said edge of said flange.

18. A closure for a container having an outwardly projecting flange spaced from the opening in the container, said closure having a body portion with means for closing the opening in the container, a skirt flared outwardly and depending downwardly from said body portion and terminating within the confines of said flange, means for supporting a portion of said skirt relative to said container, at least one segment of said skirt being unsupported by said supporting means, and means for depressing said unsupported segment of said skirt toward said container, whereby said depressing of said segment distorts a portion of said skirt outward beyond the projecting flange to facilitate stripping the closure from the container.

* * * * *